US006296998B1

(12) United States Patent
Eikenberry et al.

(10) Patent No.: US 6,296,998 B1
(45) Date of Patent: Oct. 2, 2001

(54) PHOTOGRAPHIC ELEMENT CONTAINING BIS AU(I) COMPLEXES AND SULFIDING AGENT

(75) Inventors: Jon N. Eikenberry; Roger Lok; Robert D. Wilson, all of Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/666,909

(22) Filed: Sep. 21, 2000

(51) Int. Cl.[7] ..... G30C 1/06

(52) U.S. Cl. ..... 430/603; 430/605; 430/567; 430/569; 430/449

(58) Field of Search ..... 430/567, 569, 430/599, 603, 605, 449

(56) References Cited

U.S. PATENT DOCUMENTS

| | | | | |
|---|---|---|---|---|
| 4,810,626 | | 3/1989 | Burgmaier et al. . | |
| 5,210,002 | * | 5/1993 | Adin | 430/605 |
| 5,641,621 | * | 6/1997 | Hahm et al. | 430/569 |
| 5,759,760 | * | 6/1998 | Lushington et al. | 430/603 |
| 5,759,761 | * | 6/1998 | Lushington et al. | 430/605 |
| 5,912,111 | * | 6/1999 | Lok et al. | 430/603 |
| 5,912,112 | | 6/1999 | Lok et al. . | |
| 5,939,245 | * | 8/1999 | Lok et al. | 430/605 |
| 5,945,270 | | 8/1999 | Lok et al. . | |
| 6,034,249 | | 3/2000 | Lok et al. . | |
| 6,159,676 | | 12/2000 | Lin et al. . | |

* cited by examiner

*Primary Examiner*—Geraldine Letscher
(74) *Attorney, Agent, or Firm*—Paul A. Leipold

(57) ABSTRACT

The invention relates to an emulsion comprising bromide grains wherein said grains are chemically sensitized with a water soluble Au(I) complex having the formula

[L—Au—L]M wherein the complex is symmetrical; L is an organomercapto ligand which has antifogging, stabilizing, or sensitizing properties, and M is a cationic counter ion and a rapid sulfiding agent represented by structure SS-1:

SS-1 wherein each of the $R_1$, $R_2$, $R_3$, and $R_4$ groups independently represents an alkylene, cycloalkylene, carbocyclic arylene, heterocyclic arylene, alkarylene or aralkylene group; or taken together with the nitrogen atom to which they are attached, $R_1$ and $R_2$ or $R_3$ and $R_4$ can complete a 5- to 7-membered heterocyclic ring; and each of the $B_1$, $B_2$, $B_3$, and $B_4$ groups independently is hydrogen or represents a carboxylic, sulfinic, sulfonic, hydroxamic, mercapto, sulfonamido or primary or secondary amino nucleophilic group, with the proviso that at least one of the $B_1R_1$ to $B_4R_4$ groups contains the nucleophilic group bonded to a urea nitrogen atom through a 1 - or 2-membered chain.

18 Claims, No Drawings

PHOTOGRAPHIC ELEMENT CONTAINING BIS AU(I) COMPLEXES AND SULFIDING AGENT

FIELD OF THE INVENTION

This invention relates to photographic elements. It particularly relates to an improved silver halide utilizing a water soluble gold complex and a rapid sulfiding agent.

BACKGROUND OF THE INVENTION

There has been considerable effort devoted to improving the sensitivity of silver halide crystals to actinic radiation and thereby increasing the sensitivity of the photographic elements in which they are contained. In this regard, photographic chemists have attempted to vary the components of, or the processes for making, silver halide emulsions. One particularly preferred means to improve sensitivity has been to chemically sensitize photographic emulsions with one or more compounds containing labile atoms of gold, sulfur, selenium, or the like. Examples of chemically sensitized photographic silver halide emulsion layers are described in, for example, *Research Disclosure*, Item No. 308119, December 1989, Section III, and the references listed therein. (*Research Disclosure* is published by Kenneth Mason Publications Ltd, Dudley Annex, 12a North Street, Emsworth, Hampshire PO10 7DQ, England.)

Many gold sensitizers have been described. For example, U.S. Pat. No. 3,503,749 describes the use of water soluble Au(I) thiolate salts comprising one Au atom ligated to one sulfur containing ligand. U.S. Pat. No. 5,220,030 teaches the use of Au(I) compounds with bis mesoionic heterocycles. U.S. Pat. No. 5,252,455 and U.S. Pat. No. 5,391,727 disclose the use of Au(I) macrocyclic cationic sensitizers. U.S. Pat. No. 5,049,484 teaches the use of Au(I) sensitizers having a Au atom ligated to the nitrogen atom of heterocyclic rings. U.S. Pat. No. 5,620,841 discloses the use of gelatin dispersions of a Au(I) thiosulfonato sensitizer with two different ligands, at least one of which is mesoionic, and U.S. Pat. No. 5,700,631 teaches the use of gelatin dispersions of Au(I) thiosulfonato sensitizers with two different ligands, at least one of which is a thioether group. JP 8069075 discusses the use of organic gold sulfide compounds in the sensitization of low-fogging and high contrast silver halide photographic materials. However, all of the above compounds have one or more disadvantages such as lack of water solubility, difficulty of synthesis, or poor stability.

An improved gold sensitizer avoiding the above difficulties has been described by Lok et al in U.S. Pat. No. 5,912,112. Although a more convenient gold source, chemical sensitizations with this material in combination with common sulfur sources such as thiosulfate do not always yield acceptable fog levels.

Other patents relating to Au(I) complexes are U.S. Pat. Nos. 5,945,270 and 6,034,249 of Lok et al.

PROBLEM TO BE SOLVED BY THE INVENTION

Thus, there is still need for a combination of a convenient gold source with a sulfur source that provides lower fog levels while producing acceptable or improved photographic speeds.

SUMMARY OF THE INVENTION

The invention relates to an emulsion comprising bromide grains wherein said grains are chemically sensitized with a water soluble Au(I) complex having the formula

[L—Au—L]M wherein the complex is symmetrical; L is an organomercapto ligand which has antifogging, stabilizing, or sensitizing properties, and M is a cationic counter ion and a rapid sulfiding agent represented by structure SS-1:

SS-1

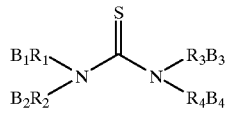

wherein each of the $R_1$, $R_2$, $R_3$, and R4 groups independently represents an alkylene, cycloalkylene, carbocyclic arylene, heterocyclic arylene, alkarylene or aralkylene group; or taken together with the nitrogen atom to which they are attached, $R_1$ and $R_2$ or $R_3$ and $R_4$ can complete a 5- to 7-membered heterocyclic ring; and each of the $B_1$, $B_2$, $B_3$, and $B_4$ groups independently is hydrogen or represents a carboxylic, sulfinic, sulfonic, hydroxamic, mercapto, sulfonamido or primary or secondary amino nucleophilic group, with the proviso that at least one of the $B_1R_1$ to $B_4$R4 groups contains the nucleophilic group bonded to a urea nitrogen atom through a 1- or 2-membered chain.

ADVANTAGEOUS EFFECT OF THE INVENTION

The invention provides a photographic element with improved fog performance, as well as providing improved or acceptable photographic speed.

DETAILED DESCRIPTION OF THE INVENTION

This invention relates to a photographic element comprising a support and a silver halide emulsion layer, the emulsion layer comprising a water soluble Au(I) complex having the formula

[L—Au—L]M wherein the complex is symmetrical; L is an organomercapto ligand which has antifogging, stabilizing, or sensitizing properties, and M is a cationic counter ion. This invention further relates to a silver halide photographic element comprising a support and a silver halide emulsion layer, the emulsion layer comprising an organomercapto Au(I) complex having the formula $$[(M—SOL)_n—A—S—Au—S—A—(SOL—M)_n]M$$

wherein

M is a cationic counterion;

SOL is a solubilizing group:

A is a substituted or unsubstituted divalent organic linking group;

and n is 1 to 4 and wherein the compound is symmetrical.

This invention also provides a silver halide photographic element comprising a support and a silver halide emulsion layer, the emulsion layer having been chemically sensitized in the presence of an organomercapto Au(I) complex having the above formula.

It further provides a method of preparing a silver halide emulsion comprising precipitating silver halide grains in an aqueous colloidal medium to form an emulsion, heating the emulsion, and adding to the emulsion, either before or during heating, an organomercapto Au(I) complex of the above formula in combination with a rapid sulfiding agent represented by structure SS-1:

SS-1

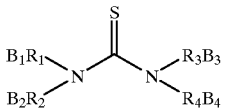

wherein each of the $R_1$, $R_2$, $R_3$, and $R_4$ groups independently represents an alkylene, cycloalkylene, carbocyclic arylene, heterocyclic arylene, alkarylene or aralkylene group; or taken together with the nitrogen atom to which they are attached, $R_1$, and $R_2$ or $R_3$ and $R_4$ can complete a 5- to 7-membered heterocyclic ring; and each of the $B_1$, $B_2$, $B_3$, and $B_4$ groups independently is hydrogen or represents a carboxylic, sulfinic, sulfonic, hydroxamic, mercapto, sulfonamido or primary or secondary amino nucleophilic group, with the proviso that at least one of the $B_1R_1$ to $B_4R_4$ groups contains the nucleophilic group bonded to a urea nitrogen atom through a 1- or 2-membered chain.

A preferred group of rapid sulfiding agents having the general SS-1 structure is that wherein each of the $R_1$, $R_2$, $R_3$, and R4 groups independently represents an alkylene group having 1 to 6 carbon atoms; and each of the $B_1$, $B_2$, $B_3$, and $B_4$ groups independently is hydrogen or represents a carboxylic, sulfinic, sulfonic, hydroxamic group;

with the proviso that at least one of the $B_1R_1$ to B4R4 groups contains the nucleophilic group bonded to a urea nitrogen atom through a 1- or 2-membered chain.

The novel organomercapto Au(I) complexes contained in the photographic elements of this invention have numerous advantages. They are highly effective sensitizers for silver halide emulsions. They are also highly water soluble. Because of the water solubility of these complexes, the use of costly and time consuming preparation of gel dispersions is unnecessary. Further, there is no need to use large volumes of water for dissolving the complexes.

Unlike prior mixed-ligand gold compounds, the two Au ligands in the complexes of this invention are identical, thus reducing the complexity of preparation. Further, the complexes utilize inexpensive and commercially available starting materials. Another advantage is that the preparation of the gold complexes of the present invention does not utilize dangerous explosive gold fulminates or large quantities of organic solvents.

Additionally, because of the stability of the covalent gold and sulfur bonds, the complexes of the present invention are more stable than those having mesoionic ligands. Indeed, there is evidence that even in acidic solutions, the complexes of the present invention are more stable than those of the mesoionic sensitizers.

The organomercaptides used in the preparation of the Au(I) complexes may include the numerous thiolic antifoggants/stabilizers. Because of the sensitizing, antifogging, and stabilizing properties of these thiolic ligands, the Au(I) sensitizers derived from these ligands may also show speed enhancing and antifogging/stabilizing effects in addition to their sensitizing properties.

The water soluble organomercapto Au(I) complexes of this invention may be represented by the formula

[L—Au—L]M wherein the complex is symmetrical. L is an organomercapto ligand which has antifogging, stabilizing, or sensitizing properties and which is suitable for use in a silver halide photographic element. Many such ligands are known in the art and are either commercially available or may be prepared as described in *Research Disclosure* 274 (1984). Some suitable ligands include thiolic ligands having hydrophilic substituents such as mercaptoazoles, examples of which are contained in U.S. Pat. Nos. 3,266,897; 4,607,004; 3,266,897; 4,920,043; 4,912,026; 5,011,768 and U.K. Patent 1,275,701. M is a cationic counterion.

The organomercapto Au(I) complexes of the invention may be further represented by the formula

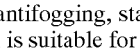

$[(M—SOL)_n—A—S—Au—S—A—(SOL—M)_n]M$ with the complex being symmetrical. M is a cationic counterion. Preferably M is an alkali metal, for example, potassium, sodium or cesium, or an ammonium cation, for example, a tetrabutyl or tetraethyl ammonium group. SOL is a water solubilizing group, suitable examples of which are sulfato, sulfonato, sulfinato, phosphato, and carboxy groups. n is an integer from 1 to 4, and more preferably n is 1 or2.

A is a substituted or unsubstituted divalent organic radical. Preferably A is an aliphatic, (cyclic or acyclic), aromatic or heterocyclic divalent group. When A is an aliphatic group, preferably it is a substituted or unsubstituted alphatic group having 1 to 20 carbon atoms, and more preferably having 1 to 8 carbon atoms. Examples of appropriate groups include alkylene groups such as ethylene, methylene, propylene, butylene, pentylene, hexylene, octylene, 2-ethylhexylene, decylene, dodecylene, hexadecylene, octadecylene, cyclohexylene, isopropylene and t-butylene groups.

The preferred aromatic groups have from 6 to 20 carbon atoms.

More preferably, the aromatic groups have 6 to 10 carbon atoms and include, among others, phenylene and naphthylene groups. These groups may have substituent groups. The heterocyclic groups are preferably substituted or unsubstituted divalent 3- to 15-membered rings with at least one atom selected from nitrogen, oxygen, sulfur, selenium, and tellurium in the ring nucleus. More preferably, the heterocyclic groups are 5- to 6-membered rings with at least one atom, and preferably more than one atom, selected from nitrogen. Examples of heterocyclic groups include the divalent radicals of pyrrolidine, piperidine, pyridine, tetrahydrofuran, thiophene, oxazole, thiazole, imidazole, benzothiazole, benzoxazole, benzimidazole, selenazole, benzoselenazole, tellurazole, triazole, benzotriazole, tetrazole, oxadiazole, or thiadiazole rings. The preferred heterocyclic group is tetrazole.

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be bonded to the remainder of the molecule by an atom of carbon, silicon, oxygen, nitrogen, phosphorous, or sulfur. Suitable substituents for A include, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-l-yl, N-methyltetradecanamido, N-succinimido, N-phthalimido, 2,5-dioxo-1 -oxazolidinyl, 3-dodecyl-2,5-dioxo- 1 -imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl) ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3- (dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy) butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3- to 7-membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy. One particularly suitable substituent for A is a benzamido group.

Generally, the above groups and substituents thereof may include those having up to 48 carbon atoms, typically 1 to 36 carbon atoms and usually less than 24 carbon atoms, but greater numbers are possible depending on the particular substituents selected.

When A is substituted, $(SOL—M)_n$ may be attached to the substituent. In one suitable embodiment, $A—(SOL—M)_n$ (wherein n is 1) is

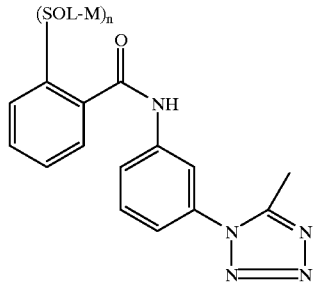

Specific examples of the Au(I) complexes include, but are not limited to (A)

$NaAu—(SCH_2CO_2Na)_2$ (B)

$NaAu—(SCH_2CH_2CHOMeCH_2OPO_3Na)_2$ (C)

$NaAu—(SCH_2CHOHCH_2SO_3Na)_2$ (D)

$NaAu—(SCH_2CH_2SO_2Na)_2$ (E)

$KAu—(SCHMeCHClCH_2CH_2SO_3K)_2$ (F)

$CsAu—(SCH_2CHCNCH_2CH_2PO_3Cs)_2$ (G)

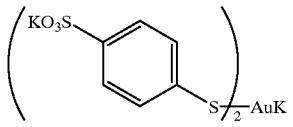

(H)

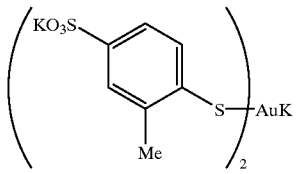

(I)

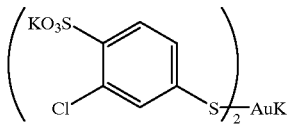

-continued (J)

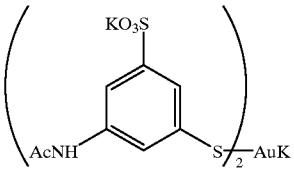

(K)

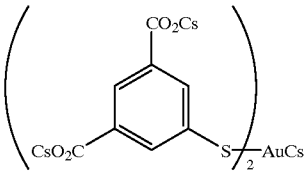

(L)

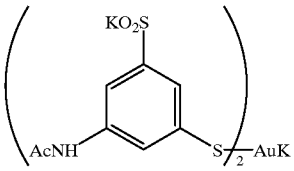

(M)

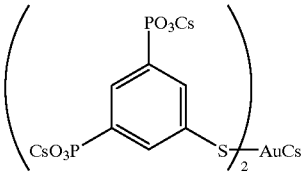

(N)

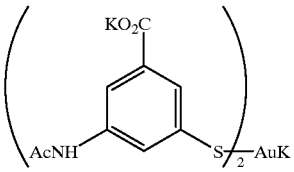

(O)

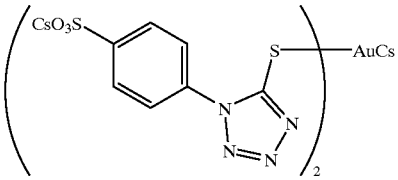

(P)

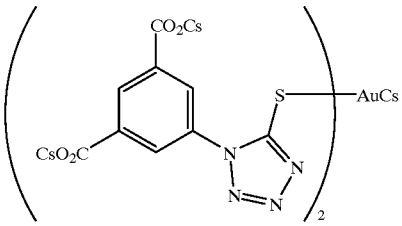

(Q)

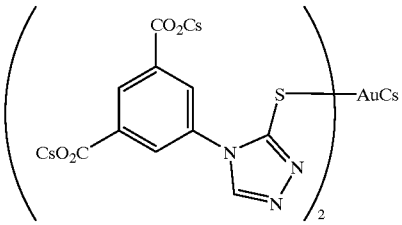

-continued (R)

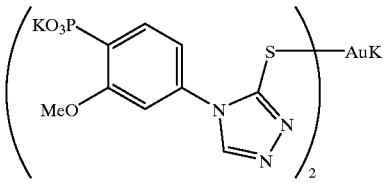

(GS-2)

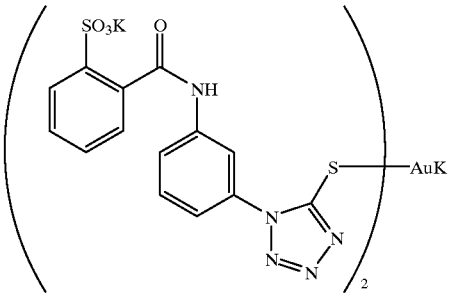

(T)

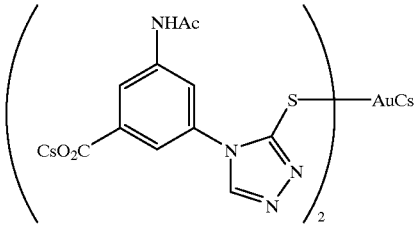

(U)

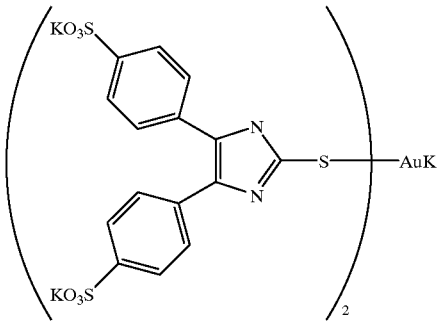

(V)

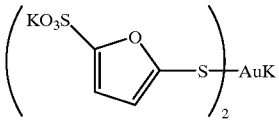

(X)

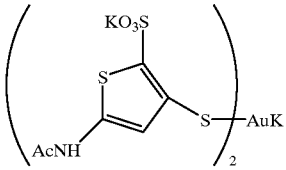

One particularly suitable complex is Compound GS-2, potassium bis(1-[3-(2-sulfonatobenzamido)phenyl]-5-mercaptotetrazole potassium salt) aurate(I) pentahydrate.

One of the advantages of the complexes of this invention is their solubility in water. Preferably, they have a solubility at 22° C. of 2 g/L, more preferably 5 g/L, and most preferably 10 g/L. Particularly suitable compounds have a solubility of greater than 20 g/L.

The organomercapto Au(I) complexes are manufactured by reacting an Au(I) complex with an organomercapto ligand and isolating the resulting organomercapto Au(I) complex from the reaction mixture by any suitable method, for example, by the treatment of the reaction mixture with several equivalents of an alkali halide or by the addition of a water miscible non- solvent. The solid Au(I) complex may be collected by filtration and dried in vacuo. The preferred method of isolation typically involves the introduction of an alkali halide followed by cooling of the reaction solution. The material is isolated by suction filtration and treated with chilled aqueous alcohol washes, such as butanol, isopropanol, ethanol. etc. The procedure is straightforward with no complicated operations or multiple recrystallizations. A detailed description of the preparation and isolation process can be found in Lok et al in U.S. Pat. No. 5,912,112.

The photographic emulsions of this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

A particularly useful application of the invention involves sensitizations employing rapid sulfiding agents comprised of tetrasubstituted middle chalcogen ureas as first disclosed in Burgmaier and Herz in U.S. Pat. No. 4,810,626. An especially preferred urea of this type is represented by structures SS-1a and SS-1b.

SS-1a

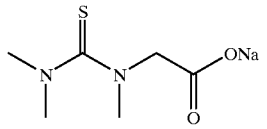

SS-1b

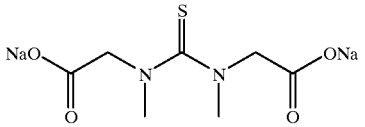

These compounds have been shown to be very effective sensitizers under mild digestion conditions and were shown to produce higher speeds than many other thiourea compounds that were lacking the specified nucleophilic substituents. A particularly useful application of these tetrasubstituted thioureas involves the sensitization of tabular grain emulsions comprising epitaxially deposited silver halide protrusions at the corners and edges of the host tabular emulsion (e.g., Daubendiek et al U.S. Pat. Nos. 5,576,168 and 5,573,902; Olm et al U.S. Pat. Nos. 5,503,970 and 5,576,171; and Deaton et al U.S. Pat. No. 5,582,965). Tabular grain emulsions without epitaxial deposition are also excellent substrates for treatment with tetrasubstituted thioureas (see, for example, Deaton U.S. Pat. No. 5,049,485 and Lin et al U.S. patent application Ser. No. 08/985,532 filed Dec. 5, 1997).

Spectral sensitization is effected with one or more dyes, which are designed for the wavelength range of interest within the visible or infrared spectrum. It is known to add such dyes both before and after heat treatment.

After spectral and chemical sensitization, the emulsion is coated on a support. Various coating techniques include dip coating, air knife coating, curtain coating, and extrusion coating.

The organomercapto Au(I) complexes and rapid sulfiding agents may be added to the silver halide emulsion at any time during the preparation of the emulsion, i.e., during precipitation, during or before chemical sensitization or during final melting and co-mixing of the emulsion and additives for coating. Preferably, the emulsion is chemically sensitized in the presence of the organomercapto Au(I) complexes and rapid sulfiding agents. More preferably, these compounds are added after precipitation of the grains, and most preferably they are added before or during the heat treatment of the chemical sensitization step.

The organomercapto Au(I) complexes and rapid sulfiding agents may be introduced into the emulsion at the appropriate time by any of the various techniques known to those skilled in the art. Preferably, they are added as an aqueous solution to the emulsion. One suitable method includes preparing a silver halide emulsion by precipitating silver halide grains in an aqueous colloidal medium to form an emulsion, digesting (heating) the emulsion, preferably at a temperature in the range of 40 to 80° C., and adding to the emulsion, either before or during heating, an aqueous solution of the rapid sulfiding agents and the organomercapto Au(I) complex. The order of addition of the sulfur and gold sources in the examples herein is sulfur followed by gold but is not limited to this sequence.

Conditions for sensitizing silver halide grains such a pH, pAg, and temperature are not particularly limited. The pH is generally about 1 to 9, preferably about 3 to 6, and pAg is generally about 5 to 12, preferably from about 7to 10.

The organomercapto Au(I) complexes and rapid sulfiding agents may also be added to the vessel containing the aqueous gelatin salt solution before the start of the precipitation; or to a salt solution during precipitation. Other modes are also contemplated. Temperature, stirring, addition rates, and other precipitation factors may be set within conventional ranges, by means known in the art, so as to obtain the desired physical characteristics.

The organomercapto Au(I) complexes and rapid sulfiding agents may be used in addition to any conventional sensitizers as commonly practiced in the art. Combinations of more than one organomercapto Au(I) complex may be utilized.

Useful levels of the rapid sulfiding agents of the present invention may range from 0.03 $\mu$mol to 30,000 $\mu$mol per silver mole. Preferred range may be from 0.15 $\mu$mol to 3,000 $\mu$mol per silver mole. A more preferred range is from 0.3 $\mu$mol to 1500 $\mu$mol per silver mole. The most preferred range is from 3 $\mu$mol to 150 $\mu$mol/Ag mole.

Useful levels of Au(I) sensitizers of the present invention may range from 0.01 $\mu$mol to 10,000 $\mu$mol per silver mole. Preferred range may be from 0.05 $\mu$mol to 1,000 $\mu$mol per silver mole. A more preferred range is from 0.1 $\mu$mol to 500 $\mu$mol per silver mole. The most preferred range is from 1 $\mu$mol to 50 $\mu$mol/Ag mole.

Any emulsion can be utilized in the sensitization process of the invention. However, the process has found a preferred use with four broad classes of photographic emulsions: 1) non-tabular bromoiodide emulsions; 2) tabular bromoiodide emulsions; 3) tabular bromide host emulsions with chlorobromide epitaxy; 4) tabular bromoiodide host emulsions with chlorobromoiodide epitaxy. All of these emulsions are useful for different applications in color negative and color reversal films. Emulsions in Class 1 are commonly employed as the fast component in the blue layer of color film because of their native light absorption. Emulsions in Class 2 are widely used in color negative film because of robust manufacturing properties combined with an efficient speed/grain response. Emulsions in Class 3 and Class 4 have exceptional speed/grain characteristics as described by Lin et al, U.S. patent application Ser. No. 08/985,532, filed Dec. 5, 1997.

The non-tabular, bromoiodide emulsions (Class 1) contain grains with a structured iodide matrix and are generally referred to as high iodide core, three-dimensional (HIC/3D) emulsions. Tabular bromoiodide emulsions (Class 2) may be prepared by running iodide into the making vessel continuously (run iodide emulsions) or dumping the iodide abruptly into the making vessel (dump iodide emulsions) or by a combination of the two, commonly referred to as run/dump emulsions. Of the three types of tabular bromoiodide emulsions, the dump iodide type has been found especially useful in this application. The tabular, bromide host emulsions in Class 3 with chlorobromide epitaxy were made by first preparing a bromide host and then applying an epitaxy in the reaction vessel at the end of the make as described by Brust et al in U.S. Pat. No. 6,100,019. These emulsions will be described as in-situ epitaxy (ISE) emulsions. The tabular bromoiodide host emulsions with chlorobromoiodide epitaxy employed herein (Class 4) were prepared according to the method described by Antoniades et al in U.S. Pat. No. 5,250,403 which yield ultrathin grains of moderate dispersity. Epitaxy was applied to these emulsions during sensitization as described by Daubendiek et al U.S. Pat. No. 5,576,168 and 5,573,902; Olm et al U.S. Pat. Nos. 5,503,970 and 5,576,171; and Deaton et al U.S. Pat. No. 5,582,965. Emulsions of this type are referred to as ultrathin, epitaxy sensitized (UES).

The crystals formed in the precipitation step are chemically and spectrally sensitized by adding spectral sensitizing dyes and chemical sensitizers, and by providing a heating step during which the emulsion temperature is raised, typically from 40° C. to between 50 and 70° C., and maintained for a period of time. The precipitation and spectral and chemical sensitization methods utilized in preparing the emulsions employed in the invention can be those methods known in the art. Typical chemical sensitizations are performed with conventional middle chalcogen (i.e., sulfur, selenium, tellurium) sensitizers and/or noble metal sensitizers such as gold compounds. Reduction sensitizers, employed individually or in combination, are specifically contemplated.

A general summary of conventional approaches to chemical sensitizations can be found in *Research Disclosure*, Item 38957, Section III. Chemical Sensitization. Kofron et al in U.S. Pat. No. 4,439,520 illustrates the application of these sensitizations to tabular grain emulsions, as well as describing advantages for "dye in the finish" sensitizations, which are those that introduce the spectral sensitizing dye into the emulsion prior to the heating step (finish) that results in chemical sensitization. Dye in the finish sensitizations are particularly advantageous in the practice of the present invention employing UES emulsions since the spectral sensitizing dye is adsorbed to the surfaces of the tabular grains to act as a site director for silver salt epitaxial deposition. Subject to modifications specifically described below, the preferred techniques for chemical and spectral sensitization of UES emulsions are those described by Maskasky in U.S. Pat. No. 4,435,501. A more general summary of useful spectral sensitizing dyes is provided by *Research Disclosure*, December 1989, Item 38957, Section IV.

Spectral sensitization and desensitization, A. Spectral sensitizing dyes.

Specific dopants, such as compounds of copper, thallium, lead, bismuth, cadmium and Group VIII nobel metals, can be present during process of the present invention or during preparation of silver halide grains employed in the emulsion layers of the photographic element. Other dopants include transition metal complexes as described in U.S. Pat. Nos. 4,981,781; 4,937,180; and 4,933,272.

The photographic emulsions may be incorporated into color negative or reversal photographic elements. The photographic element may also comprise a transparent magnetic recording layer such as a layer containing magnetic particles on the underside of a transparent support, as described in *Research Disclosure*, November 1992, Item 34390 published by Kenneth Mason Publications, Ltd., Dudley Annex, 12a North Street, Emsworth, Hampshire PO10 7DQ, ENGLAND. Typically, the element will have a total thickness (excluding the support) of from about 5 to about 30 $\mu$m. Further, the photographic elements may have an annealed polyethylene naphthalate film base such as described in Hatsumei Kyoukai Koukai Gihou No. 94-6023, published Mar. 15, 1994 (Patent Office of Japan and Library of Congress of Japan) and may be utilized in a small format system, such as described in *Research Disclosure*, June 1994, Item 36230 published by Kenneth Mason Publications, Ltd., Dudley Annex, 12a North Street, Emsworth, Hampshire PO10 7DQ, ENGLAND, and such as the Advanced Photo System, particularly the Kodak ADVANTIX films or cameras. In the following Table, reference will be made to (1) *Research Disclosure*, December 1978, Item 17643, (2) *Research Disclosure*, December 1989, Item 308119, (3) *Research Disclosure*, September 1994, Item 36544, and (4) *Research Disclosure*, September 1996, Item 38957, all published by Kenneth Mason Publications, Ltd., Dudley Annex, 12a North Street, Emsworth, Hampshire PO10 7DQ, ENGLAND. The Table and the references cited in the Table are to be read as describing particular components suitable for use in the elements of the invention. The Table and its cited references also describe suitable ways of preparing, exposing, processing and manipulating the elements, and the images contained therein. Photographic elements and methods of processing such elements particularly suitable for use with this invention are described in *Research Disclosure*, February 1995, Item 37038, published by Kenneth Mason Publications, Ltd., Dudley Annex, 12a North Street, Emsworth, Hampshire PO10 7DQ, ENGLAND.

| Reference | Section | Subject Matter |
|---|---|---|
| 1 | I, II | Grain composition, |
| 2 | I, II, IX, X, XI, XII, XIV, XV | morphology and preparation. Emulsion preparation |
| 3 & 4 | I, II, III, IX A & B | including hardeners, coating aids, addenda, etc. |
| 1 | III, IV | Chemical sensitization and |
| 2 | III, IV | spectral sensitization/ |
| 3 & 4 | IV, V | desensitization |
| 1 | V | UV dyes, optical brighteners, |
| 2 | V | luminescent dyes |
| 3 & 4 | VI | |
| 1 | VI | Antifoggants and stabilizers |
| 2 | VI | |
| 3 & 4 | VII | |
| 1 | VIII | Absorbing and scattering |
| 2 | VIII, XIII, XVI | materials; Antistatic layers; |
| 3 & 4 | VIII, IX C & D | matting agents |

-continued

| Reference | Section | Subject Matter |
|---|---|---|
| 1 | VII | Image-couplers and image- |
| 2 | VII | modifying couplers; Wash-out |
| 3 & 4 | X | couplers; Dye stabilizers and hue modifiers |
| 1 | XVII | Supports |
| 2 | XVII | |
| 3 & 4 | XV | |
| 3 & 4 | XI | Specific layer arrangements |
| 3 & 4 | XII, XIII | Negative working emulsions; Direct positive emulsions |
| 2 | XVIII | Exposure |
| 3 & 4 | XVI | |
| 1 | XIX, XX | Chemical processing; |
| 2 | XIX, XX, XXII | Developing agents |
| 3 & 4 | XVIII, XIX, XX | |
| 3 & 4 | XIV | Scanning and digital processing procedures |

The photographic elements can be incorporated into exposure structures intended for repeated use or exposure structures intended for limited use, variously referred to as single use cameras, lens with film, or photosensitive material package units.

The photographic elements can be exposed with various forms of energy which encompass the ultraviolet, visible, and infrared regions of the electromagnetic spectrum, as well as the electron beam, beta radiation, gamma radiation, X-ray, alpha particle, neutron radiation, and other forms of corpuscular and wave-like radiant energy in either noncoherent (random phase) forms or coherent (in phase) forms, as produced by lasers. When the photographic elements are intended to be exposed by X-rays, they can include features found in conventional radiographic elements.

The photographic elements are preferably exposed to actinic radiation, typically in the visible region of the spectrum, to form a latent image, and then processed to form a visible dye image. Development is typically followed by the conventional steps of bleaching, fixing, or bleach-fixing to remove silver or silver halide, washing, and drying.

The following examples illustrate the practice of this invention. They are not intended to be exhaustive of all possible variations of the invention. Parts and percentages are by weight unless otherwise indicated.

EXAMPLES

Emulsion A

This is a HIC/3D emulsion prepared using a thiocyanate digest as follows: Into a reaction vessel with good mixing was added 6.8 L of distilled water, 196 g of lime-processed, bone gelatin, 233.2 g of sodium bromide, 34 g of potassium iodide and 1.36 g of antifoamant and, while keeping the temperature at 53° C., an aqueous solution consisting of 1.405 moles/L silver nitrate was added at the rate of 125 mL/min for 23.46 min simultaneously with the addition of a solution consisting of 2.466 M sodium bromide and 0.154 M potassium iodide added at the rate of 141.7 mL/min. The addition of halide solution was then terminated and the addition of silver nitrate solution was continued for an additional 23.46 min. The vessel temperature was raised to 76° C. over a period of 11.5 min, and an aqueous solution of 19 g of sodium thiocyanate in 28 mL was then added. After a hold time of 25 min the vessel was cooled to 45° C. and the excess salts were removed by ultrafiltration. The yield was 8.24 moles of a polymorphic emulsion containing 8.9% iodide and with an average size of 1.16 $\mu$m.

Sensitization A-1 (Comparison)

Emulsion A was treated sequentially with potassium chloride; sodium thiocyanate; yellow sensitizing dye, SD-1 (see Chemical Structures below); sulfur sensitizer, SS-1a, as described in U.S. Pat. No. 4,810,626; gold sensitizer, GS-3; finish modifier, FM; and latent image doctor, LID-1, as described in U.S. Pat. No. 4,378,426. The emulsion was then incubated for 5 min at 64° C. Following cooling to 40° C., the emulsion was treated with antifoggants, AF-1 and AF-2. The amounts of the sulfur and gold sensitizers used for this and other sensitizations can be found in Table 2.

Sensitization A-2 (Comparison)

Emulsion A was treated sequentially with potassium chloride; sodium thiocyanate; finish modifier, FM; yellow sensitizing dye, SD-1; gold sulfide; sulfur sensitizer, SS-1a, as above; gold sensitizer, GS-1, as described in U.S. Pat. No. 5,049,485; and latent image doctor, LID-1. The emulsion was then incubated for 12 min at 62° C. Following cooling to 40° C., the emulsion was treated with antifoggants, AF-1 and AF-2.

Sensitization A-3 (Invention)

Emulsion A was treated as in Sensitization A-2 except GS-2 was used in place of GS-1 at twice the mass so as to introduce the same molar equivalent.

Photographic Evaluation

The sensitized emulsion samples were coated over a pad of gelatin on a cellulose acetate film support with an antihalation backing. Coated with the emulsion were a colored coupler and, in some examples, an inhibitor releasing coupler was included. A protective gelatin overcoat containing hardener was also applied.

The dried coated samples were given 0.01 s Wratten 2B or Wratten 23A filtered daylight (5500° K.) exposure through a 21 step calibrated neutral density step tablet. The exposed samples were developed in the color negative Kodak FlexicolorTM C41 process. Speed was measured in relative log units as 00(1-logH) where H is the exposure in lux-sec necessary to produce a density 0.15 above D-min.

Emulsion B

This is a tabular, dump iodide, bromoiodide emulsion in which all of the iodide was added abruptly at about 68% of the make by dumping into the reaction vessel a silver iodide seed emulsion and then performing a silver overrun. A 0.84 M silver nitrate solution was added at the rate of 35 mL/min for 7.5 min into a reaction vessel with good stirring and containing 18.4 g of oxidized, lime-processed, bone gelatin, 32.2 g sodium bromide, and antifoamant in 4.6 L of distilled water maintained at 40° C. Following nucleation, an ammonia digest was performed with 0.45 moles of ammonia at pH 10 for 1 min. An additional 222 g of oxidized, lime-processed, bone gelatin together with 1 1.4 g of sodium bromide and additional antifoamant in 3.0 L of distilled water was added and the pH was adjusted to 5.8. Growth was initiated by the addition of 0.84 M silver nitrate at a flow rate of 7.3 mL/min which was increased to 15.5 over a period of 6.5 min. Growth was continued by the equimolar addition of 0.84 M silver nitrate with sodium bromide in a double-jet mode maintaining a pBr of 1.89 for a period of 8.5 min. The silver flow rate was ramped during this time from 15.5 to 26.2 mL/min. The silver nitrate solution was then changed to 3.0 M and growth was continued for 45.5 min ramping the flow from 7.3 to 156 mL/min. 314 $\mu$g $K_4Ru(CN)_6$ was added to the reaction vessel during the last minute of growth. Flow was stopped while 0.4 L of 4.1 M sodium bromide was added, followed by 2.5 mg of KSeCN and 0.565 mol of silver iodide seeds. A silver overrun was performed by adding 3.0 M silver nitrate at the rate of 40 mL/min for 13.2 min. A balancing flow of sodium bromide was used to limit the drop in bromide concentration to a pBr of 2.70. Excess salt was removed by ultrafiltration to yield 12.6 moles of emulsion containing an average of 4.5% iodide with a grain size of 0.78×0.099 μm.

Sensitization B-1 (Comparison)

Emulsion B was treated sequentially with antifoggant, AF-3, as described in U.S. Pat. No. 5,576,170; sodium thiocyanate; finish modifier, FM; sensitizing dyes, SD-2 and SD-3; sulfur sensitizer, SS-1a; and gold sensitizer GS-1. The emulsion was heated for 12 min at 60° C., cooled to 40° C., and treated with antifoggants, AF-1 and AF-4.

Sensitization B-2 (Invention)

Emulsion B was treated as in Sensitization B-1 except gold sensitizer GS-2 was used in place of GS-1, the sulfur and gold levels were adjusted to get optimum performance as shown in Table 2, and the heating segment was extended to 16 min.

Emulsions C, D, and E

Emulsions C, D, and E were prepared in the same manner as Emulsion B except the iodide added was 3.7% of the total on a molar basis and ammonia and temperature levels were adjusted to obtained varying sizes.

Sensitization C-1 (Comparison)

Emulsion C was treated sequentially with antifoggant, AF-3; sodium thiocyanate; finish modifier, FM; sensitizing dyes, SD-4 and SD-5; gold sensitizer GS-3; and sulfur sensitizer, SS-2. The emulsion was heated for 12 min at 60° C., cooled to 40° C., and treated with antifoggant, AF-4.

Sensitization C-2 (Invention)

Emulsion C was treated as in Sensitization C-1 except that GS-2 was substituted for GS-3, SS-1a was substituted for SS-2, the sulfur and gold levels were adjusted to get optimum performance as shown in Table 2, and the temperature of the heating segment was decreased to 56° C.

Sensitization D-1 (Comparison)

Emulsion D was treated sequentially with antifoggant, AF-3; sodium thiocyanate; finish modifier, FM; sensitizing dyes, SD-6 and SD-7; gold sensitizer, GS-3; and sulfur sensitizer, SS-2. The emulsion was heated for 10 min at 65° C., cooled to 40° C., and treated with antifoggant, AF4.

Sensitization D-2 (Invention)

Emulsion D was treated as in Sensitization D-1 except that GS-2 was substituted for GS-3, SS-1a was substituted for SS-2, the sulfur and gold levels were adjusted to get optimum performance as shown in Table 2, and the time and temperature of the heating segment were changed to 15 min at 56° C.

Sensitization E-1 (Comparison)

Emulsion E was treated sequentially with antifoggant, AF-3; sodium thiocyanate; finish modifier, FM; sensitizing dyes, SD4 and SD-S; gold sensitizer, GS-3; and sulfur sensitizer, SS-2. The emulsion was heated for 24 min at 56° C., cooled to 40° C., and treated with antifoggant, AF4.

Sensitization E-2 (Invention)

Emulsion E was treated as in Sensitization E-1 except that GS-2 was substituted for GS-3, SS-1a was substituted for SS-2, the sulfur and gold levels were adjusted to get optimum performance as shown in Table 2, and the time of the heating segment was changed to 6 min.

Sensitization F-1 (Comparison)

Emulsion F was treated sequentially with sodium thiocyanate;

finish modifier, FM; sensitizing dyes, SD-4 and SD-5; gold sensitizer, GS-3; and sulfur sensitizer, SS-2. The emulsion was heated for 20 min at 65° C., cooled to 40° C., and treated with antifoggant, AF-4.

Sensitization F-2 (Invention)

Emulsion F was treated as in Sensitization F-1 except that GS-2 was substituted for GS-3, SS-la was substituted for SS-2, the sulfur and gold levels were adjusted to get optimum performance as shown in Table 2, and the time and temperature of the heating segment were changed to 15 min at 62° C.

Emulsion G

This is an in-situ epitaxy emulsion (ISE) prepared by first precipitating a host tabular bromide emulsion, treating it with iodide and then attaching a chlorobromide epitaxy while the emulsion is still in the original reaction vessel. A 0.35 M silver nitrate solution was added simultaneously in a double-jet mode with an equimolar sodium bromide solution at the rate of 14.3 mL/min for 1 min into a reaction vessel with good stirring and containing 2.5 g of oxidized, lime-processed, bone gelatin, 0.35 g of Pluronic-31™, 3.13 g sodium bromide, and 29 mL of 4 M nitric acid in 4.96 L of distilled water maintained at 30° C. After a 1 min hold, the temperature was raised to 60° C. in 18 min. 100 g of oxidized, lime-processed, bone gelatin in 1.41 L of distilled water together with 0.1 g of Pluronic-31™ was added followed by 45 mL of 2.5 M sodium hydroxide. Growth was conducted over a period of 85 min by the equimolar addition of silver nitrate and sodium bromide in a double-jet mode maintaining a pBr of 1.69. The flow rates were ramped during this time from 0.005 to 0.2 moles of silver/min so that a total of 4.99 moles of silver was precipitated. Growth was then continued at a steady flow rate of 0.2 moles/min for an additional 20.24 min. The epitaxy was then applied by first adding lime-processed, bone gelatin in the amount of 95.4 g in 176 mL of distilled water. The temperature was dropped to 40° C. in 20 min, then 71.7 g of sodium chloride in 3.09 L was added. A 3.5 M silver nitrate solution was added at the rate of 50 mL/min for 3 min followed by a 0.38 M potassium iodide at 70.8 mL/min for 10 min. A solution of potassium ruthenium cyanide was then added in the amount of 18 μmol/Ag mol of total make followed by 3.5 M silver nitrate at the rate of 262 mL/min for 0.5 min. Excess salt was removed by ultrafiltration to yield 8.04 moles of emulsion. The content of the epitaxy is estimated to be $AgCl_{0.71}Br_{0.28}I_{0.002}$ and constitutes 6% of the total emulsion. The epitaxy deposits are clearly visible as nodules on the corners of the tabular grains. The emulsion size was 4.62×0.080 μm.

Sensitization G-1

Emulsion G was treated sequentially with antifoggant, AF-3; sodium thiocyanate; sensitizing dyes, SD-1 and SD-7; sulfur sensitizer, SS-1a; gold sensitizer, GS-1; finish modifier, FM. The emulsion was heated for 10 min at 53° C., cooled to 40° C., and treated with antifoggants, AF-1 and AF-2, followed by 0.5 mg/Ag mol of speed addenda, SA, as described by Farid et al in U.S. Pat. No. 5,747,236.

Sensitization G-2

Emulsion G was treated identically as in Sensitization G-1 except an equimolar amount of GS-2 was used in place of GS-1.

Emulsion H

This is an in-situ epitaxy emulsion (ISE) emulsion prepared in a manner similar to Emulsion E except the nucleation was conducted at 45° C. in the presence of 5.56 g of sodium bromide with 0.5 M silver nitrate flowing at 65.1 mL/min for 1 min. In addition, an ammonia digest was conducted following the temperature ramp from 40 to 60° C. The amount of ammonia used was 0.3 moles. The yield was 15.5 moles, 4.85×0.134 μm.

Sensitization H-1

Emulsion H was treated sequentially with antifoggant, AF-3; sodium thiocyanate; sensitizing dye SD-1; sulfur sensitizer, SS-1a; gold sensitizer, GS-1; finish modifier, FM and then heated for 10 min at 53° C., cooled to 40° C., and treated with antifoggants, AF-1 and AF-2, followed by 0.5 mg/Ag mol of speed addenda, SA.

Sensitization H-2

Emulsion H was treated as in Sensitization H-1 except GS-2 was used in place of GS-1 and the sulfur and gold levels were adjusted slightly to obtain optimum performance as shown in Table 2.

Emulsion I

This is an ultrathin epitaxy sensitized (UES) emulsion prepared by precipitating a host structured-iodide tabular emulsion and applying epitaxy during the sensitization. A 2.38 M silver nitrate solution and a 2.38 M sodium halide ($Br_{0.95}I_{0.05}$) solution were introduced with thorough mixing over 0.25 min at 105.6 mL/min in a double-jet mode into 6.56 L of distilled water held constant at 50° C. in a reaction vessel containing 3.24 g sodium bromide, 25.2 g of oxidized lime-processed bone gelatin, an antifoamant and sufficient sulfuric acid to bring the pH to 2.0. After a 14 min hold, 70 g more of oxidized gelatin was added in a basic aqueous solution such that the pH increased to 6.0. Sufficient 1.0 M NaBr was then added 19 min after nucleation to bring the pBr to 1.95. Growth was carried out over 87 min at 50° C. with 2.38 M silver nitrate, 2.5 M sodium bromide, and a stream of silver iodide Lippmann emulsion such that the first 75% of the make consisted of $AgBr_{0.98}I_{0.02}$ and the last 25% of $AgBr_{0.88}I_{0.12}$ producing a bulk iodide content of 4.5%. The first 20.33 min of the 59.83 min required for the inner 75% was carried out with a gradation of the pBr from 1.95 to 1.7 which was then held constant for the rest of the make. Silver nitrate flow during the inner 75% of growth was ramped from 11.0 to 76.8 mL/min. After 70% of the silver had been deposited, $K_2IrCl_6$ was added in the amount of 0.01 mg/mol of total silver. For the last 25% of the make the silver nitrate flow was ramped from 16.3 to 47.3 mL/min over 27.23 min. The emulsion was brought to 45 ° C. and excess salts were removed by ultrafiltration. The emulsion was stored at pH 6.0 and pBr 3.4. The yield was 8.9 moles of a tabular emulsion, 1.05×0.053 μm.

Sensitization I-1 (Comparison)

A 1 mole sample of emulsion I was melted at 40° C. and its pBr was adjusted to ca. 4 with a simultaneous addition of silver nitrate and potassium iodide solutions in the molar ratio of 1/0.12. Then 2 mol % of sodium chloride was added followed by the red spectral sensitizing dyes, SD-4 and SD-8, in the amounts of respectively of 0.38 mmol/Ag mol and 1.52 mmol/Ag mol. After a 40 min hold, the epitaxy was formed via single jet sequential addition of calcium chloride, sodium bromide, silver iodide, and silver nitrate. The additions are performed in 3 min or less and result in observable epitaxial depositions on most of the corners of the grains in the emulsion. The epitaxy constitutes 6 mol % of the total emulsion and based on the ratio of halide added should consist of $AgCl_{0.42}Br_{0.42}I_{0.16}$.

The sensitization of the epitaxial emulsion was completed by the sequential addition of sodium thiocyanate; sulfur sensitizer, SS-1b; gold sensitizer, GS-1; antifoggants AF-1, AF-5, and AF-3. The mixture was heated to 55° C. for 25 min, cooled to 40 ° C, and treated with additional antifoggant, AF-1.

Sensitization 1-2 (Invention)

Emulsion I was treated as in Sensitization I-1 except gold sensitizer, GS-2, was substituted for GS-1 in an equimolar amount.

Emulsion J

Emulsion J was a repeat preparation of Emulsion I. Data in Table 1 show it to be an exact replicate within measurement noise.

Sensitization J-1 (Comparison)

Emulsion J was treated as in Sensitization I-1 except the sensitizing dyes SD-8 and SD-9 were employed, SS-1a replaced SS-1b, and sulfur and gold levels were adjusted slightly for optimum performance.

Sensitization J-2 (Invention)

Emulsion J was sensitized as in Sensitization J-1 except gold sensitizeder, GS-2, was used in place of GS-1 in an equimolar amount.

The emulsions and their sensitizations utilized in this invention are summarized in Tables 1 and 2. The emulsions constitute a diversity of morphologies and grain sizes, while the sensitizations spectrally include all three color records that would be used in a complete color film.

TABLE 1

Characteristics of Emulsions and Their Sensitization

| Example | Emulsion | Type* | Emulsion Size (μm) | Spectral Sensitizer | Emulsion Color |
|---|---|---|---|---|---|
| A-1,-2, -3 | A | HIC/3D | 1.16 | SD-1 | Yellow |
| B-1,-2 | F | 4.5% Dump | 0.78 × 0.099 | SD-2/SD-3 | Magenta |
| C-1,-2 | C | 3.7% Dump | 2.10 × 0.110 | SD-4/SD-5 | Cyan |
| D-1,-2 | D | 3.7% Dump | 3.64 × 0.122 | SD-6/SD-7 | Yellow |
| E-1,-2 | E | 3.7% Dump | 2.30 × 0.117 | SD-4/SD-5 | Cyan |
| F-1,-2 | B | 2% Dump | 0.45 × 0.060 | SD-4/SD-5 | Cyan |
| G-1,-2 | G | ISE | 4.26 × 0.120 | SD-1/SD-7 | Yellow |
| H-1,-2 | H | ISE | 4.85 × 0.134 | SD-1 | Yellow |
| I-1,-2 | I | UES | 1.05 × 0.053 | SD-4/SD-8 | Cyan |
| J-1,-2 | J | UES | 1.10 × 0.050 | SD-8/SD-9 | Cyan |

*HIC/3D refers to a 3D emulsion prepared with a high iodide core, A % Dump Type refers to the addition of given % iodide to a tabular grain emulsion wherein the iodide is added abruptly as a dump into the reaction vessel. ISE refers to a tabular grain emulsion with an epitaxy applied insitu duing the making of the emulsion. UES refers to an ultra-thin, tabular grain emulsion having epitaxy applied during sensitization.

The data listed in Table 2 demonstrate the successful sensitization of a wide range of silver bromoiodide emulsions under a variety of conditions with GS-2 in combination with SS-1. The data consistently show lower fog levels when GS-2 is combined with SS-1 relative to those obtained with more conventional sulfur and gold sensitizers, thereby providing improved photographic performance while utilizing materials that allow the sensitization to proceed under mild conditions with a gold source having improved stability, water solubility, and ease of preparation.

TABLE 2

Characteristics and Photographic Performance of Sensitizations

| Example | S Sensitizer | S Level# (μmol/Ag mol) | Au Sensitizer | Au Level (μmol/Ag mol) | Fog | Speed |
|---|---|---|---|---|---|---|
| A-1 (comparison) | SS-1a | 7.6 | GS-3 | 4.75 | 0.14 | 291 |
| A-2 (comparison) | SS-1a | 13.1 | GS-1 | 3.64 | 0.12 | 296 |
| A-3 (invention) | SS-1a | 13.1 | GS-2 | 3.64 | 0.10 | 296 |
| B-1 (comparison) | SS-1a | 21.2 | GS-1 | 6.14 | 0.15 | 246 |
| B-2 (invention) | SS-1a | 21.2 | GS-2 | 6.06 | 0.12 | 246 |
| C-1 (comparison) | SS-2 | 14.5 | GS-3 | 4.75 | 0.14 | 293 |
| C-2 (invention) | SS-1a | 10.1 | GS-2 | 2.60 | 0.07 | 291 |
| D-1 (comparison) | SS-2 | 23.3 | GS-3 | 7.60 | 0.09 | 266 |
| D-2 (invention) | SS-1a | 15.4 | GS-2 | 4.33 | 0.06 | 270 |
| E-1 (comparison) | SS-2 | 11.6 | GS-3 | 3.80 | 0.14 | 297 |
| E-2 (invention) | SS-1a | 10.1 | GS-2 | 2.60 | 0.12 | 297 |
| F-1 (comparison) | SS-2 | 174 | GS-3 | 57 | 0.08 | 164 |
| F-2 (invention) | SS-1a | 101 | GS-2 | 27.7 | 0.06 | 168 |
| G-1 (comparison) | SS-1a | 20.2 | GS-1 | 7.02 | 0.19 | 312 |
| G-2 (invention) | SS-1a | 20.2 | GS-2 | 6.93 | 0.14 | 313 |
| H-1 (comparison) | SS-1a | 22.7 | GS-1 | 10.5 | 0.12 | 284 |
| H-2 (invention) | SS-1a | 20.2 | GS-2 | 6.93 | 0.09 | 286 |
| I-1 (comparison) | SS-1b | 21.7 | GS-1 | 3.65 | 0.43 | 227 |
| I-2 (invention) | SS-1b | 21.7 | GS-2 | 3.64 | 0.31 | 226 |
| J-1 (comparison) | SS-1a | 17.1 | GS-1 | 4.47 | 0.31 | 222 |
| J-2 (invention) | SS-1a | 17.1 | GS-2 | 4.47 | 0.29 | 224 |

#The S (sulfur) level represents the total sulfur added, i.e., that from the S sensitizer and that from the Au sensitizer if sulfur is present in the Au sensitizer.

Chemical Structures

FM

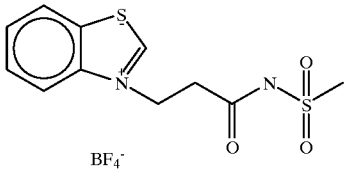

GS-1

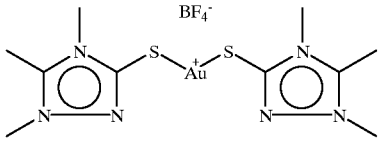

SS-1a

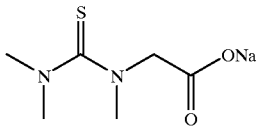

SS-1b

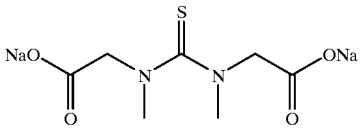

-continued

GS-2

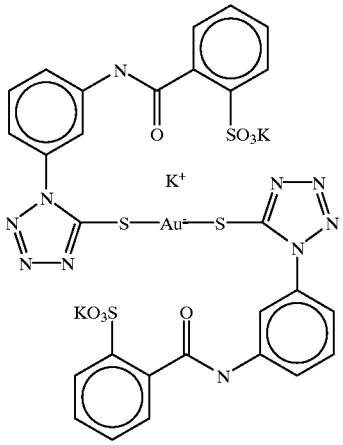

SS-2

$Na_2S_2O_3$

GS-3

$Na_3Au(S_2O_3)_2$

LID-1

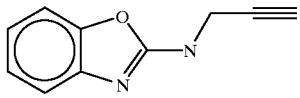

-continued
SA
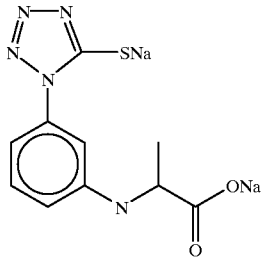
SD-1
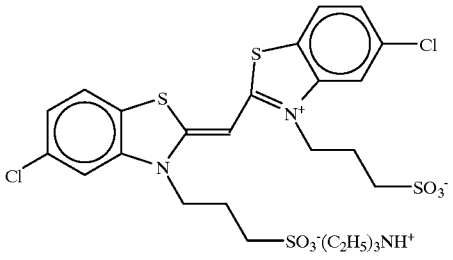
SD-2
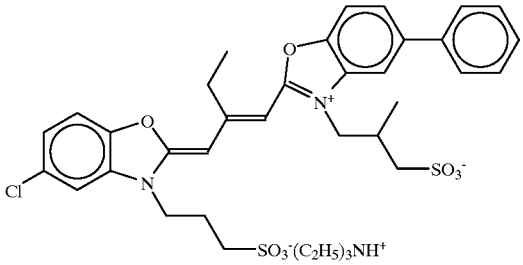
SD-3
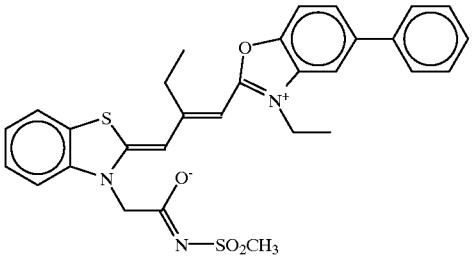
SD-4
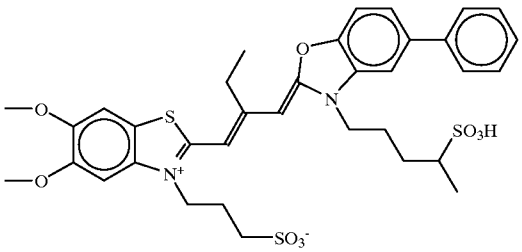
-continued
SD-5
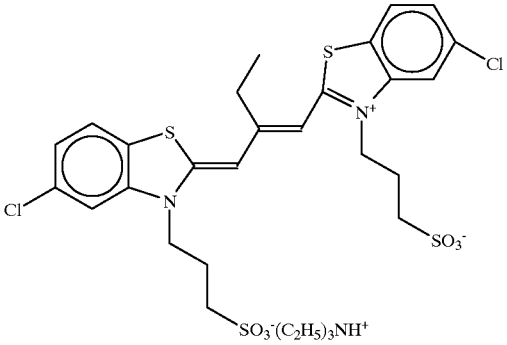
SD-6
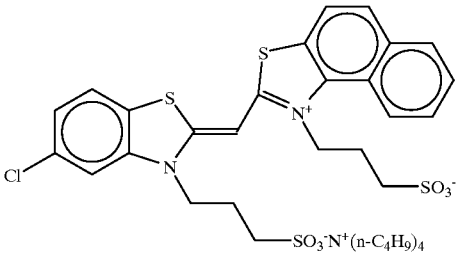
SD-7
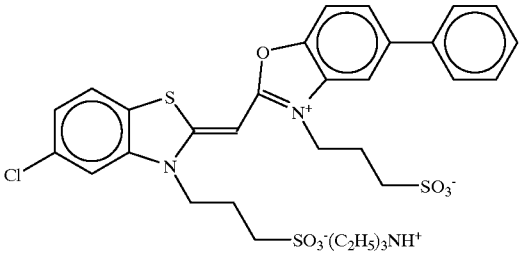
SD-8
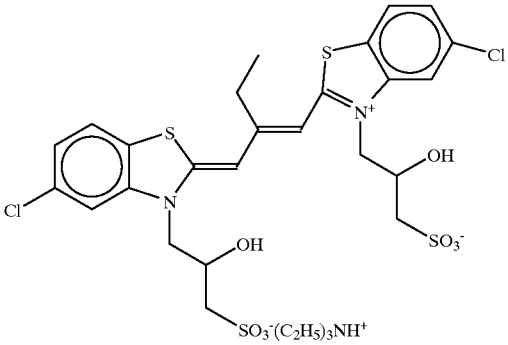

-continued

SD-9

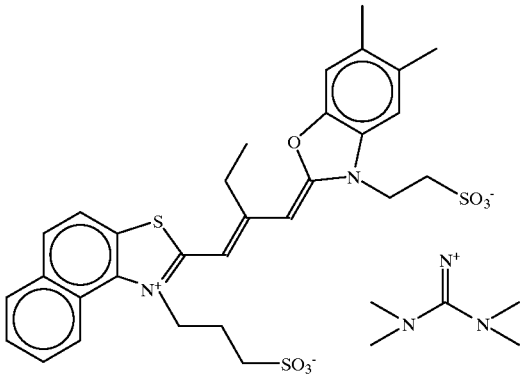

AF-1

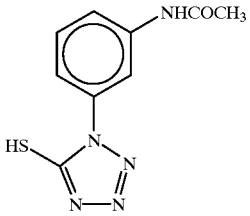

AF-2

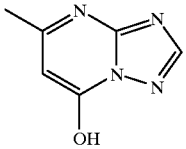

AF-3

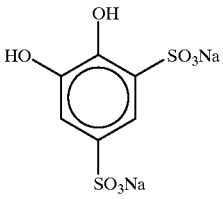

AF-4

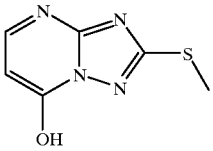

AF-5

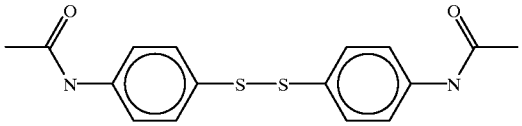

The invention has been described in detail with particular reference to certain preferred embodiments thereof, but it will be understood that variations and modifications can be effected within the spirit and scope of the invention.

What is claimed is:

1. An emulsion comprising bromide grains wherein said grains are chemically sensitized with a water soluble Au(I) complex having the formula $$[L—Au—L]M$$

wherein the complex is symmetrical; L is an organomercapto ligand which has antifogging, stabilizing, or sensitizing properties, and M is a cationic counter ion and a rapid sulfiding agent represented by structure SS-1:

SS-1

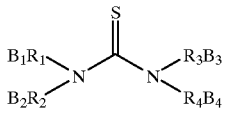

wherein each of the $R_1$, $R_2$, $R_3$, and $R_4$ groups independently represents an alkylene, cycloalkylene, carbocyclic arylene, heterocyclic arylene, alkarylene or aralkylene group; or taken together with the nitrogen atom to which they are attached, $R_1$ and $R_2$ or $R_3$ and R4 can complete a 5- to 7-membered heterocyclic ring; and each of the $B_1$, $B_2$, $B_3$, and $B_4$ groups independently is hydrogen or represents a carboxylic, sulfinic, sulfonic, hydroxamic, mercapto, sulfonamido or primary or secondary amino nucleophilic group, with the proviso that at least one of the $B_1R_1$ to $B_4R4$ groups contains the nucleophilic group bonded to a urea nitrogen atom through a 1 - or 2-membered chain, wherein said emulsion has epitaxy.

2. The emulsion of claim 1 wherein said water soluble Au(I) complex comprises an organomercapto Au(I) complex having the formula $$[(M—SOL)_n—A—S—Au—S—A—(SOL—M)_n]M$$

wherein

M is a cationic counterion;

SOL is a solubilizing group:

A is a substituted or unsubstituted divalent organic linking group;

and n is 1 to 4 and wherein the compound is symmetrical.

3. The emulsion of claim 1 wherein said emulsion has chloroiodide epitaxy.

4. The emulsion of claim 1 wherein said emulsion has chlorobromoiodide epitaxy.

5. The emulsion of claim 1 wherein said bromide grains contain 0–10% iodide.

6. The emulsion of claim 2 wherein said organomercapto Au(I) complex comprises:

$$[(M—SOL)_n—A—S—Au—S—A—(SOL—M)_n]M$$

wherein the substituent, A, is represented by:

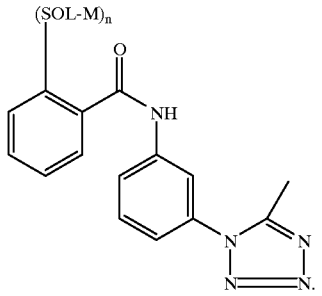

7. The emulsion of claim 2 wherein said rapid sulfiding agent comprises:

SS-1

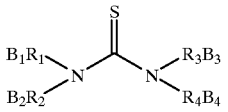

wherein each of the $R_1$, $R_2$, $R_3$, and $R_4$ groups independently represents an alkylene group having 1 to 6 carbon atoms; and each of the $B_1$, $B_2$, $B_3$, and $B_4$ groups independently is hydrogen or represents a carboxylic, sulfinic, sulfonic, hydroxamic group;

with the proviso that at least one of the $B_1R_1$ to $B_4R_4$ groups contains the nucleophilic group bonded to a urea nitrogen atom through a 1 - or 2-membered chain.

8. The emulsion of claim 2 wherein the organomercapto Au(l) complex has the structure, GS-2:

GS-2

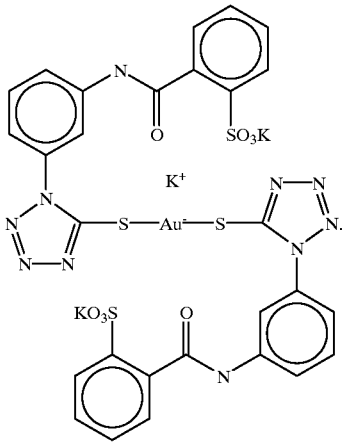

9. The emulsion of claim 1 wherein said rapid sulfiding agent comprisies the structures, SS-1a and SS-1b:

SS-1a

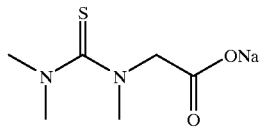

-continued

SS-1b

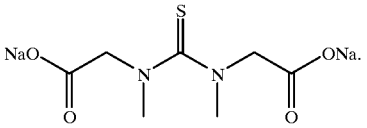

10. A method of preparing a silver halide emulsion comprising precipitating silver halide grains in an aqueous colloidal medium to form an emulsion, heating the emulsion, and adding to the emulsion, either before or during heating, an organomercapto Au(I) complex having the formula $$[L—Au—L]M$$

wherein the complex is symmetrical; L is an organomercapto ligand which has antifogging, stabilizing, or sensitizing properties, and M is a cationic counter ion and a rapid sulfiding agent represented by the structure SS-1:

SS-1

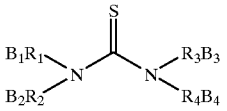

wherein each of the $R_1$, $R_2$, $R_3$, and $R_4$ groups independently represents an alkylene, cycloalkylene, carbocyclic arylene, heterocyclic arylene, alkarylene or aralkylene group; or taken together with the nitrogen atom to which they are attached, $R_1$ and $R_2$ or $R_3$ and $R_4$ can complete a 5- to 7-membered heterocyclic ring; and each of the $B_1$, $B_2$, $B_3$, and $B_4$ groups independently is hydrogen or represents a carboxylic, sulfinic, sulfonic, hydroxamic, mercapto, sulfonamido or primary or secondary amino nucleophilic group, with the proviso that at least one of the $B_1R_1$ to $B_4R_4$ groups contains the nucleophilic group bonded to a urea nitrogen atom through a 1- or 2-membered chain, and wherein said emulsion has epitaxy.

11. The method of claim 10 wherein said Au(I) complex comprises organomercapto Au(I) complex having the formula $$[(M—SOL)_n—A—S—Au—S—A—(SOL—M)_n]M$$

wherein M is a cationic counterion;

SOL is a solubilizing group:

A is a substituted or unsubstituted divalent organic linking group;

and n is 1 to 4 and wherein the compound is symmetrical.

12. The method of claim 10 wherein said emulsion has chloroiodide epitaxy.

13. The method of claim 10 wherein said emulsion has chlorobromoiodide epitaxy.

14. The method of claim 10 wherein said bromide grains contain 0–10% iodide.

15. The method of claim 10 wherein said organomercapto Au(I) complex comprises:

$$[(M—SOL)_n—A—S—Au—S—A—(SOL—M)_n]M$$

wherein the substituent, A, is represented by:

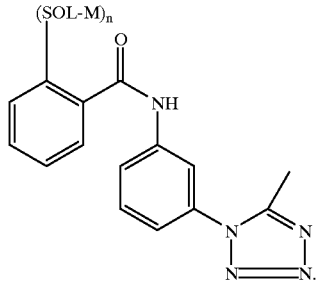

16. The method of claim 11 wherein said rapid sulfiding agent comprises:

SS-1

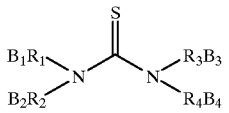

wherein each of the $R_1$, $R_2$, $R_3$, and $R_4$ groups independently represents an alkylene group having 1 to 6 carbon atoms; and each of the $B_1$, $B_2$, $B_3$, and $B_4$ groups independently is hydrogen or represents a carboxylic, sulfinic, sulfonic, hydroxamic group;

with the proviso that at least one of the $B_1R_1$ to $B_4R_4$ groups contains the nucleophilic group bonded to a urea nitrogen atom through a 1 - or 2-membered chain.

17. The method of claim 10 wherein the organomercapto Au(I) complex has the structure, GS-2:

GS-2

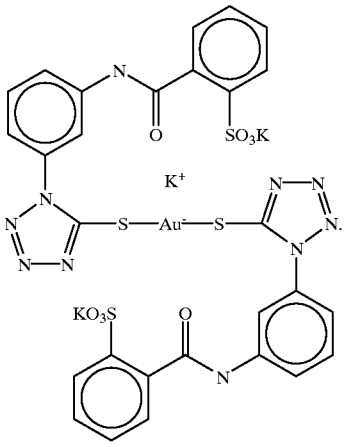

18. The method of claim 10 wherein said rapid sulfiding agent comprisies the structures, SS-1a and SS-1b:

SS-1a

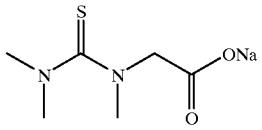

SS-1b

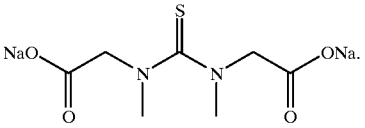

* * * * *